United States Patent [19]

Karvinen et al.

[11] Patent Number: 4,526,655

[45] Date of Patent: Jul. 2, 1985

[54] PRESS SECTION WITH SEPARATE PRESS NIPS IN A PAPER MACHINE

[75] Inventors: Mikko Karvinen, Vihtavuori; Jorma Laapotti, Jyväskylä, both of Finland

[73] Assignee: Valmet Oy, Finland

[21] Appl. No.: 531,297

[22] Filed: Sep. 12, 1983

[30] Foreign Application Priority Data

Sep. 15, 1982 [FI] Finland ..... 823187

[51] Int. Cl.[3] ..... D21F 3/04

[52] U.S. Cl. ..... 162/360.1; 162/305; 162/359

[58] Field of Search ..... ..... 162/360, 359, 358, 305, 162/306, 205, 206

[56] References Cited

U.S. PATENT DOCUMENTS

| | | | |
|---|---|---|---|
| 3,215,592 | 11/1965 | Justus et al. | 162/358 |
| 3,268,390 | 8/1966 | Ely, Sr. | 162/360 |
| 3,293,121 | 12/1966 | Martin | 162/358 |
| 4,201,624 | 5/1980 | Mohr et al. | 162/305 |
| 4,219,383 | 8/1980 | Valkama | 162/305 |
| 4,483,745 | 11/1984 | Wicks et al. | 162/360.1 |

FOREIGN PATENT DOCUMENTS

| | | | |
|---|---|---|---|
| 686863 | 2/1953 | United Kingdom | 162/360.1 |
| 774213 | 5/1957 | United Kingdom | 162/360 |
| 2127448 | 4/1984 | United Kingdom . | |

*Primary Examiner*—William Smith
*Assistant Examiner*—K. M. Hastings
*Attorney, Agent, or Firm*—Steinberg & Raskin

[57] ABSTRACT

A press section of a paper machine comprises, in the direction of web run, at least three separate press nips for removing water from a web, the web passing between two fabrics in each of the three nips. Dewatering of the web takes place through both faces of the web at least in the first press nip which is formed between two open-faced press rolls. The second and third press nips are formed between an open-faced roll and one of an open-faced roll and a smooth-faced roll. According to the invention, the press section includes two upper fabrics and two lower fabrics, the first upper and lower fabrics in the direction of web run being water-receiving press fabrics, one of which constitutes a press fabric only in the first press nip, the other fabric constituting a press fabric both in the first and second press nips. One of the second upper and lower fabrics is a water-receiving press fabric, the other being a water-non-receiving transfer fabric adapted to receive minimal amounts of water, if any. The web is transferred on the transfer fabric after the third press nip as a closed draw into the drying section which follows the press section.

14 Claims, 6 Drawing Figures

PRESS SECTION WITH SEPARATE PRESS NIPS IN A PAPER MACHINE

BACKGROUND OF THE INVENTION

The present invention relates generally to paper making and, more particularly, relates to the construction of a press section of a paper machine.

The present invention is particularly directed to improvements in press sections which include, in the direction of web passage through the press section, at least three successive, separate press nips, i.e., press nips formed by their own respective pairs of press rolls, and wherein water is removed from the web to a substantial extent. Each of the press nips has a pair of fabrics passing therethrough so that the web is situated between two fabrics as it passes through each of the three press nips. Dewatering takes place through both faces of the web in at least the first one of the three press nips, the first press nip being preferably formed between two open-faced press rolls whereas the second and third press nips are formed between an open-faced press roll and one of an open-faced press roll and a smooth-faced press roll, and wherein the first upper or lower fabric in the press section acts as a pick-up fabric onto which the web is transferred from the forming wire of the paper machine forming section.

Dewatering of a paper web by evaporation consumes large amounts of energy and is therefore a costly and uneconomical operation. For this reason, it is usually attempted to remove as much water as possible from the web by mechanical means before the web reaches the drying section of the paper machine. The last stage where water is mechanically removed from the web in a paper machine is the press section where water is removed from the web by pressing the web between rolls. It is well known that water will be more readily removed from a web when the temperature of the water is elevated since the viscosity of the water and the coefficient of compression elasticity of the web are thereby reduced as is the surface tension. In this manner, the dry matter or solid content of the web after the press section is remarkably increased resulting in significant economies in the consumption of energy in the drying section of the paper making machine.

As the rates of production of paper machines increase, one of the major bottle-necks which limit further increased production rates are the existence of free draws of the web after the press section, either from the press section to the drying section or in the first free spaces in the drying section itself.

As discussed below, one of the objectives of the present invention is to provide a method and apparatus by which the running quality or efficiency of operation of a paper machine is improved through the intensification of the dewatering of the web in the press section so that the web leaving the press section is dryer and therefore stronger than has been possible using conventional arrangements.

The most common conventional arrangement for dewatering fibrous webs, in particular paper and cardboard webs, is one wherein the web is passed through a press nip formed between two rolls situated in facing relationship to each other. As is well known, one or two press fabrics are used in such dewatering nips, the fabrics carrying the water drained from the web away from the nip and also functioning to carry the web forwardly after the press nip.

One well known press section which utilizes press nips of the type described above is the "Sym-Press" press section manufactured by the assignee of the instant application, Valmet Oy of Finland. The details of the Sym-Press press section are disclosed in Finnish Announcement Publication No. 50,651. The Sym-Press press section is a compact, so-called fully closed press section in which the paper web coming from the forming wire is passed through a first nip region formed between an open-faced roll and a suction roll, between two felts, water being drained from the paper web through both faces of the web. The press section also includes a smooth-faced central roll provided with at least one doctor device. A second nip region is formed against the smooth-faced roll by means of the suction roll mentioned above. At the second nip region, water is drained from the web through the web face which faces the second roll of the first nip region. Moreover, the press section comprises at least one additional nip region after the second nip region which is formed between the smooth-faced central roll, whose diameter is greater than those of the other press rolls in the press section, and an open-faced roll, a felt passing through the additional nip region. This additional nip region is situated substantially on the opposite side of the central roll relative to the position of the second nip region.

In the conventional press sections discussed above it has been necessary to use one or more press-suction rolls. However, the use of press-suction rolls involves considerable drawbacks, discussed in greater detail below.

For example, the perforations of a press-suction roll may leave a marking in the web which detracts from the appearance of the paper and which may affect its surface properties. Press-suction rolls are expensive and require their own separate drive motors and control systems and, furthermore, are noisy during operation. In particular, the drilling required in the manufacture of press-suction rolls is a difficult and costly procedure. The perforations reduce the strength of the mantle of the roll making it necessary to use special metal alloys in the construction of the rolls which, together with the requirement of relatively large thicknesses for the mantle, results in high material costs.

Moreover, press-suction rolls consume large quantities of air since in addition to the air which passes through the web and the felt, the suction system also receives the air that enters into the suction zone in the holes in the suction mantle during each revolution of the roll. Still further, the provision of water tight seals in the suction box of the suction roll causes difficulties.

As noted above, an important drawback inherent in the operation of suction rolls is that a great deal of noise is created during operation. Thus, a secondary objective of the present invention is to reduce the noise generated during the operation of the paper machine in general and of the press section in particular.

It is often desirable in the case of press-suction rolls to provide for a variable crown. However, as a rule, this is not possible since the mantle of the suction roll is perforated and/or since the interior space within the press-suction roll is occupied by the suction box to an extent such that under the circumstances it is not possible to fit devices for adjustably varying the crown therein.

Prior to the advent of a closed and compact press sections, such as the Sym-Press and Sym-Press II press sections of Valmet Oy, open press sections were commonly used which included several separate nips, i.e., wherein each press nip was formed between its own pair of press rolls. In this connection reference is made by way of example to U.S. Pat. Nos. 3,268,390 (Ely) and 4,219,383 (Valkama). One of the reasons why these open press sections were substantially replaced by fully closed and compact press sections was that a compact press section, e.g. the Sym-Press II press section, requires considerably less space than open press sections. Moreover, the open press sections of the type described in the U.S. patents cited above have certain additional drawbacks. For example, the web tends to become moist again after passing through the press nips and this rewetting has been particularly detrimental between the second and third nips and especially where thin paper qualities are being manufactured. As a rule, after the second nip in the prior art open press sections, the dry matter or solid content of the web has been relatively high. However, when the web is transferred into the third nip carried by the press fabric, water is transferred back into the web. For this reason, in the prior art open press sections, attempts were made to detach the web from the press fabric immediately after the third nip. However, this resulted in the necessity of carrying the web as an open draw into the drying section. As is known, open draws increase the risk of web breakage since the strength of the web is still relatively low due to its water content immediately after the press section.

Furthermore, with respect to the press section disclosed in U.S. Pat. No. 3,268,390, the transfer of the web after the second nip onto the second upper press fabric is insured by means of a suction-pick-up roll and a rewetting of the web occurs during the run of the web after the suction-pick-up roll. Moreover, in the press section disclosed in the '390 patent, the web has an open draw after the third press nip into the drying section.

In the press section discussed in U.S. Pat. No. 4,219,383, the web runs through all of the three successive press nips carried by the same lower fabric functioning as the press fabric in each nip. Accordingly, rewetting of the web occurs between the nips when the water is transferred, after the nips, from the lower fabric back into the web. Such rewetting, however, is not particularly detrimental in the case of thick paper qualities for which the press section disclosed in the '383 patent is relatively well suited.

SUMMARY OF THE INVENTION

Accordingly, it is an object of the present invention to provide a new and improved press section comprising at least three successive and separate press nips wherein the web passes through each of the three nips between two fabrics, in which press section the drawbacks discussed above are avoided.

Another object of the present invention is to provide a new and improved press section comprising separate press nips which provides a completely closed draw of the web from the forming wire onto the drying fabric.

Still another object of the present invention is to provide a new and improved press section comprising separate press nips wherein no press-suction rolls are required. In this regard, it is noted that in certain cases it is possible, and indeed may be preferable, to use one or more suction rolls in the press section at certain points although such suction rolls preferably will not constitute press-suction rolls.

A further object of the present invention is to provide a new and improved press section comprising separate press nips and wherein there is sufficient space between the press nips so that equipment, such as loading devices, doctors, and fabric guiding and conditioning means, can be placed in association with the various press rolls, and which also allows the operation and maintenance of such equipment as well as the removal of broke.

A still further object of the present invention is to provide a new and improved press section comprising separate press nips by means of which a higher dry matter content is obtained or, alternatively, in which it is possible to use pulps of lesser quality relative to that required in conventional paper machines.

An additional object of the present invention is to provide a new and improved press section comprising separate press nips which avoids or substantially reduces the problems of vibration which exist in conventional press sections and, in particular, in conventional compact press sections.

Yet another object of the present invention is to provide a new and improved press section comprising separate press nips wherein the frame construction can have a lower weight than is the case in the prior art without incurring any risk of additional vibrations.

Briefly, in accordance with the present invention, these and other objects are attained by providing an improvement in a press section which includes, in the direction of the passage of the web through the press section, at least three separate press nips, each of the press nips having a pair of fabrics passing therethrough so that the web is situated between two fabrics as it passes through each of the three press nips, the improvement comprising, that the press section includes two upper and two lower fabrics, of which fabrics the first upper and first lower fabrics are water-receiving press fabrics adapted to receive water removed from the web, and wherein one of the first upper and first lower fabrics constitutes a press fabric only in the first press nip and wherein the other of the first upper and first lower fabrics constitutes a press fabric both in the first press nip and in the second press nip, that one of the second upper and second lower fabrics is a water-receiving press fabric adapted to receive water removed from the web and wherein the other of the second upper and second lower fabrics is a water-non-receiving transfer fabric adapted to receive minimal amounts of water, if any, and that the transfer fabric constitutes means for transferring the web after the third nip as a closed draw to the drying section of the paper machine which follows the press section.

The arrangement of the press and transfer fabrics in a press section in accordance with the invention allows the web to pass as a closed draw from the forming wire onto the drying wire or drying cylinder or the like. Since a particular transfer fabric which is non-water-receiving is used in connection with the second and third nips in accordance with the invention, the transfer fabric will carry the web as a closed draw onto the drying wire or the like with no rewetting of the web occurring since the transfer fabric will not absorb water to any substantial extent and, therefore, water cannot move from the fabric back into the web. As the transfer fabric it is possible to use a completely impervious band, formed of plastic or rubber. In some cases the transfer fabric may be such that water is received therein at least to some extent, especially when thicker paper qualities are being produced. A general principle in accordance with the invention is that the thinner the paper qualities being produced, the more impervious the transfer fabric used will be.

A comparison of the press section in accordance with the invention with the Sym-Press press section indicates that in the press section of the invention, the smooth-faced central roll of the Sym-Press press section has, in a way, been replaced by the transfer fabric which is substantially non-water-receiving. However, the transfer fabric permits a completely closed draw of the web to be accomplished after the last nip to produce a favorable transfer of the web to the drying section. Such a closed draw of course contributes to the possibility of even higher web speeds through the paper machine.

Even though the press section of the present invention requires a longer space in the horizontal direction than the closed, compact press sections discussed above, this is compensated for by means of the higher dry matter content of the web obtained in the press section which allows the number of drying cylinders to be reduced and, therefore, the length of the drying section may be shortened relative to conventional drying sections, in some cases to an extent which is even greater than the amount by which the length of the press section is extended, for example, as compared with the Sym-Press press section.

Moreover, new and surprising advantages are obtained by the press section in accordance with the invention. For example, the web passes through the press section in a fully closed draw. The requirement for suction rolls is eliminated so that suction rolls can be eliminated entirely or minimized in number. Problems of vibration are reduced. Furthermore, the increased dry matter content of the web in itself improves the running quality or efficiency of the paper machine owing to the dryer web. Another advantage of the invention is that, due to the more open and less packed construction of the press section, the usability of the press section as well as the elimination of disturbances during operation and the replacement and maintenance of various components is facilitated. A further advantage of the invention is that all of the press rolls can be made with substantially equal weight which favorably affects the dimensioning of the traverse crane in the paper machine hall. Thus, in conventional press sections, the traverse crane had to be dimensioned in accordance with the weight of the stone roll which functioned as the central roll in the Sym-Press press section, the weight of the central roll being substantially greater than the weight of the press rolls used in the present invention.

The simultaneous accomplishment of the various advantages enumerated above, usually obtained only by mutually exclusive design variations, indicates a remarkable level of invention.

DETAILED DESCRIPTION OF THE DRAWINGS

A more complete appreciation of the present invention and many of the attendant advantages thereof will be readily understood by reference to the following detailed description when considered in connection with the accompanying drawings, it being understood that the invention is not restricted to the details of the illustrated embodiments, wherein.

DETAILED DESCRIPTION OF THE PREFERRED EMBODIMENTS

Figure 1:
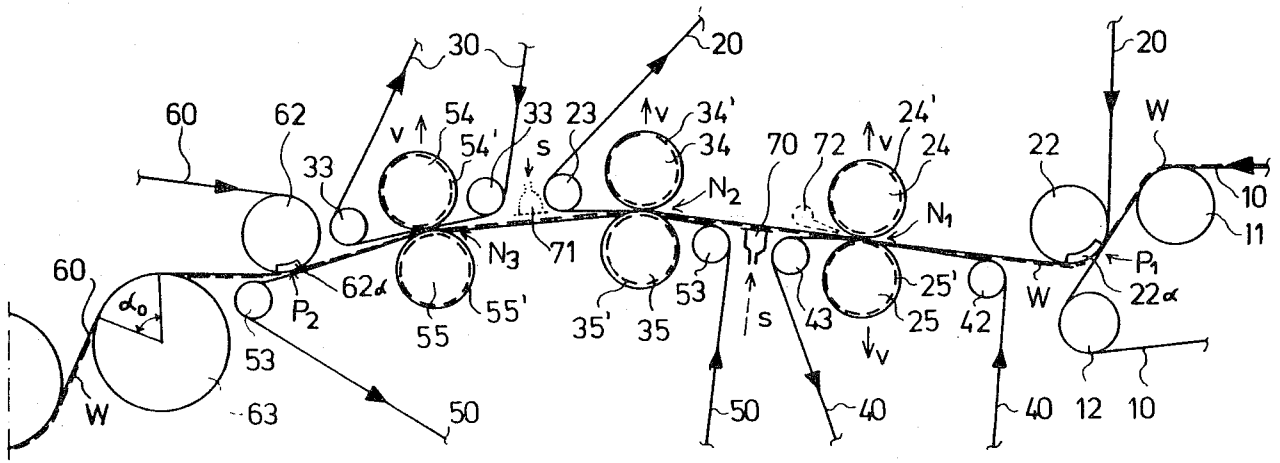
FIG. 1 is a schematic side elevation view of a press section in accordance with the invention in which a relatively impervious transfer fabric is used as the second lower fabric.
Figure 2:
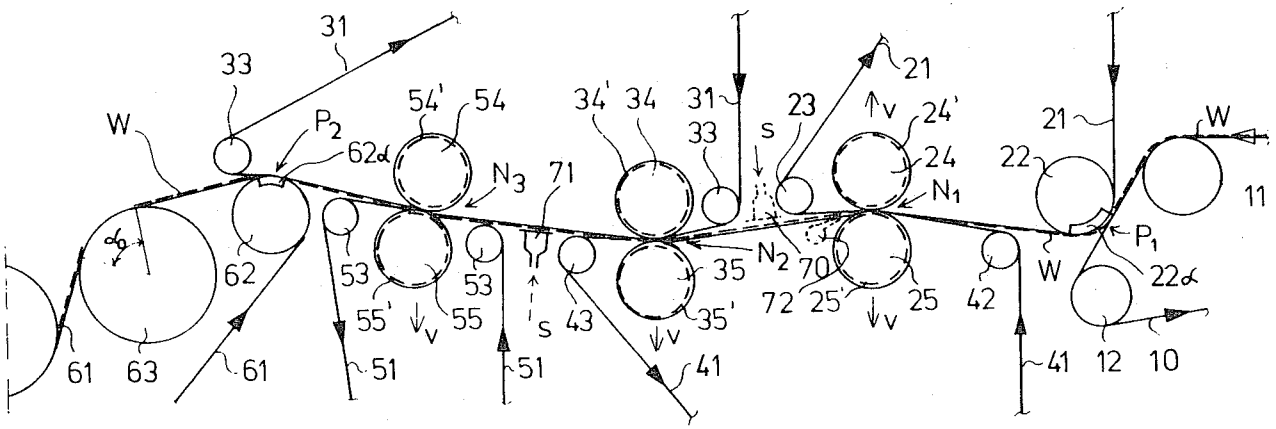
FIG. 2 is a schematic side elevation view of another embodiment of a press section in accordance with the invention in which a relatively impervious transfer fabric is used as the second upper fabric.
Figure 3:
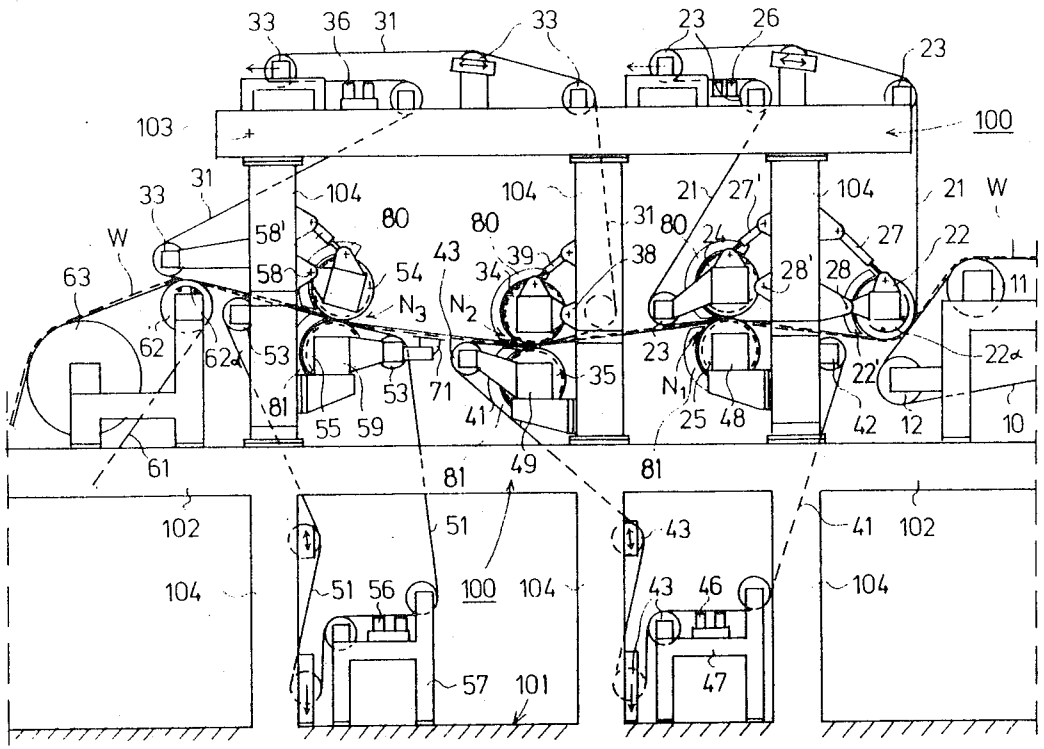
FIG. 3 is a side elevation view of the press section illustrated in FIG. 2 and further including a schematic illustration of the frame construction of the press section, as well as the support, loading and water-collecting equipment of the various press rolls, the entire run of the various fabrics, as well as the means for guiding and conditioning the fabrics.

Referring now to the drawings wherein like reference characters designate identical or corresponding parts throughout the several views and more particularly to FIGS. 1–3, the web W is formed on forming wire 10, which may be constituted either a fourdrinier wire or the supporting wire of a two-wire forming section. The web W is shifted onto the suction zone 22$\alpha$ of the pick-up roll 22 during the downwardly inclined run of the wire 10 between the wire suction roll 11 and the wire drive roll 12 at the detaching line $P_1$. The web is transferred onto the first upper fabric 20; 21, which functions both as a water-receiving press fabric and as a pick-up fabric. The fabric 20; 21 carries the web W on its bottom face into the first press nip $N_1$ formed between two press rolls 24 and 25. The nip $N_1$ is provided with two press fabrics, namely, the upper fabric 20; 21 and a first lower fabric 40; 41, which is a water-receiving press fabric. The rolls 24, 25 are open-faced press rolls having open faces designated 24' and 25', respectively. The open face 24'; 25' of the press rolls 24, 25 may be hard or soft and can be formed in any conventional manner such as by radial grooves, blind-drilled holes, or the like. A construction wherein the open face 24'; 25' of the press rolls 24, 25 is formed by spiral grooves produced by winding a band around a cylindrical core is preferable. One of the press rolls 24 and 25 may, of course, be constituted by a press-suction rolls in a known manner, even though the use of such a press-suction rolls causes certain drawbacks discussed above. Either one or both of the press rolls 24; 25 are driven rolls.

It is essential that, in the first nip $N_1$, the dewatering takes place through both faces of the web W, i.e., both into the upper fabric 20; 21 and into the lower fabric 40; 41. In this manner a symmetric yet sufficiently gentle initial dewatering is partly guaranteed. The direction in which the web is dewatered at each press nip is designated in FIGS. 1 and 2 by the arrows denoted V.

The first press nip $N_1$ is followed in the direction of run of web W by a second separate nip $N_2$ formed between two press rolls 34 and 35. In the illustrated embodiments, the press rolls 34 and 35 are provided with open faces 34'; 35', although this is not absolutely necessary.

In the embodiment of FIG. 1, the first upper fabric 20 carries the web W on its bottom face into the second nip $N_2$. That the web W will follow the upper fabric 20 after the first nip $N_1$ and not the lower fabric 40 is insured by means of the arrangement described in detail below. In the second nip $N_2$, the lower fabric is transfer fabric 50 which is relatively impervious as compared to press fabrics. Accordingly, the dewatering in the second press nip $N_2$ takes place mainly upwardly (as designated by arrow V) towards the first press fabric 20. In the FIG. 1 embodiment, the lower roll 35 of the second press nip $N_2$ may, alternatively, be a smooth-faced roll. However, as discussed below, it is preferred that the lower roll 35 be provided with an open face 35' even though there is no substantial dewatering of the web into the transfer fabric 50, i.e., towards the second lower fabric. Due to the surface properties of the transfer fabric 50 and to certain arrangements illustrated in FIG. 1 and discussed below, the web W follows along with the transfer fabric 50 after the second press nip $N_2$. The web W is carried into the third separate water-removing press nip $N_3$ by the transfer fabric 50.

Referring now to the embodiment illustrated in FIGS. 2 and 3, after the first press nip $N_1$, as a result of arrangments discussed in detail below, the web W follows along with the first lower fabric 41, which carries the web W on its top face into the second separate press nip $N_2$. The second nip $N_2$ is formed between two press rolls 34 and 35, constituted by press rolls having open faces 34' and 35'. The second nip $N_2$ is also provided with two fabrics, the lower fabric being constituted by the first lower fabric 41 which is a water-receiving, pervious press fabric, e.g., a conventional press felt. As is shown in FIG. 2, the upper fabric in the second nip $N_2$ is a transfer fabric 31 whose properties correspond to those of the transfer fabric 50 of the FIG. 1 embodiment. As illustrated in FIGS. 2 and 3, the dewatering of the web in the second press nip $N_2$ takes place mainly downwardly, i.e., in the direction towards the lower fabric 41 (arrow V) since the second upper fabric 31 is substantially impervious, being a non-water-receiving transfer fabric 31. The roll 34 may alternatively be a smooth-faced roll since it does not have to function as a water-receiving roll due to the imperviousness of the fabric 31. For reasons discussed below, it is, however, preferable to provide the roll 34 with an open face 34'. The web W is caused to follow along the bottom face of the transfer fabric 31 after the nip $N_2$ by means of certain arrangements discussed below. The web W is carried on the bottom face of the transfer fabric 31 into the third separate nip $N_3$ in the press section.

As shown in FIGS. 1–3, the third press nip $N_3$, which is a separate press nip and the last nip in the press section that effects substantial water removal from the web, is formed between two press rolls 54 and 55 which are provided with open faces 54' and 55'. Two fabrics 30, 50; 31, 51 pass through the third press nip $N_3$ between which the web W passes through the zone of the nip. As shown in FIG. 1, the lower fabric in the third press nip $N_3$ is the transfer fabric 50 while the upper fabric is a water-receiving press fabric 30. In the embodiment of FIGS. 2 and 3, the upper fabric is a transfer fabric 31 which corresponds in its properties to the fabric 50 of the FIG. 1 embodiment, while the lower fabric in the third press nip is a water-receiving press fabric 51. In FIG. 1, the lower press roll 55 may alternatively be a smooth-faced roll since the fabric 50 is substantially a non-water-receiving fabric. Correspondingly, in the embodiment of FIGS. 2 and 3, the upper press roll 54 may be a smooth-faced roll since the transfer fabric 31 is substantially non-water-receiving.

In the press section of FIG. 1, the transfer fabric 50 carries web W after the third press nip $N_3$ onto the transfer-suction roll 62 having a suction zone 62$\alpha$ over which a drying wire 60 of the paper machine drying section is passed. The web W is shifted from the transfer fabric 50 onto the drying wire 60 by the effect of the suction zone 62$\alpha$ on the line $P_2$. The web adheres to the face of drying wire 60 and is passed over the first drying cylinder or baby cylinder 63 of the drying section over a sector $\alpha_0$. The web W continues its passage, being carried by the drying wire 60, as a single-fabric draw at least in the initial part of the drying section.

In the embodiment of the press section illustrated in FIGS. 2 and 3, the web W is caused to follow the upper transfer fabric 31 after passing through the third press nip $N_3$. The web W is shifted on the bottom face of the transfer fabric 31 onto the suction zone 62$\alpha$ of the transfer-suction roll 62. The web W is shifted at the line $P_2$ within the suction zone 62$\alpha$ onto the drying wire 61 which transfers the web W further over the baby cylinder 63 of the drying section within the sector $\alpha_0$ and further at least through the initial part of the drying section as a single fabric draw. The drying section is conventional and therefore not described in further detail.

In the embodiments of FIGS. 1 and 2, the guide rolls of the first upper fabric 20, 21 are denoted by reference numeral 23. Correspondingly, the first guide roll of the first lower fabric 40, 41 in the direction of running of the web is denoted by reference numeral 42 and the other guide rolls by reference numeral 43. The guide rolls of the second upper fabric 30, 31 are denoted by reference numeral 33 and the guide rolls of the second lower fabric 50, 51 are denoted by reference numeral 53.

In the embodiments of FIGS. 1 and 2, a steam box 70 is situated between the first and second nips $N_1$ and $N_2$ to operate directly against the web W, the steam being supplied into the steam box 70 being designated by the arrow S. Correspondingly, a steam box 71 is situated between the second and third press nips $N_2$ and $N_3$ to operate directly against the web W. The steam boxes 70 and 71 function to provide the web W with a higher dry matter content by, on the one hand, lowering the viscosity of the water in the web and, on the other hand, by reducing the coefficient of compression elasticity, both phenomena being based on higher compression temperatures. Greater amounts of water can thus be removed from the web W in the nips $N_2$ and $N_3$.

Referring now to FIG. 3 which illustrates the frame construction of the press section of FIG. 2, the bearing supports of the pick-up roll 22 are supported on the frame construction 104 of the press section by means of horizontal joints 28 and loading means 27. The lower roll 25 of the first nip $N_1$ is supported on the frame construction 104 by means of stationary bearing supports 48. The bearing supports of the upper roll 24 of the first nip $N_1$ are supported on the frame construction 104 by means of horizontal joints 28' and loading means 27'. Moreover, the guide roll 23 of the upper fabric 21 is supported on the bearing supports mentioned above. Conditioning devices 26 for the first upper fabric 21 are located above the upper horizontal beam 103 of the frame construction 100. Conditioning devices 46 of the first lower fabric are located in the basement of the frame construction 47. The lower roll 35 of the second press nip $N_2$ is mounted on stationary supports 49. The bearing supports of the upper roll 34 are supported on the frame construction 104 by means of horizontal joints 38 and loading means 39. Correspondingly, the lower roll 55 of the third press nip $N_3$ is supported on the frame construction 104 by means of stationary bearing supports 59. The bearing supports of the upper roll 54 are supported on the frame construction 104 by means of horizontal joints 58 and loading means 58'. The conditioning devices 56 of the second lower fabric 51 are situated in the basement of the frame construction 57. The press rolls are provided with dewatering troughs 80 and 81 and a pick-up roll 22 is provided with a dewatering trough 22'.

In FIG. 3, the frame constructions of the press section are generally designated by reference numeral 100. The frame constructions 100 include the vertical means 104 extending upwardly from the floor level 101 of the basement as well as the horizontal means 102 at the floor level of the machine wall, and upper horizontal beams 103.

A preferred geometry of the press nips $N_1$, $N_2$ and $N_3$ of the press section of FIGS. 2 and 3 will now be described below referring to FIGS. 4, 5 and 6, respectively.

Figure 4:
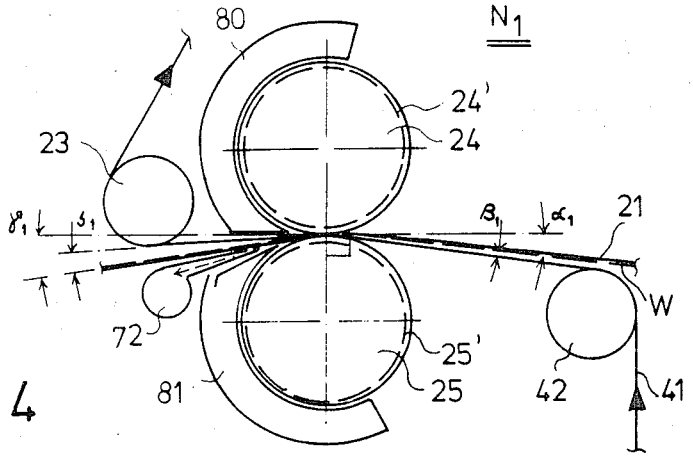
FIG. 4 is a schematic elevation view showing the detailed geometry of the first nip of the press section illustrated in FIGS. 2 and 3.
Figure 5:
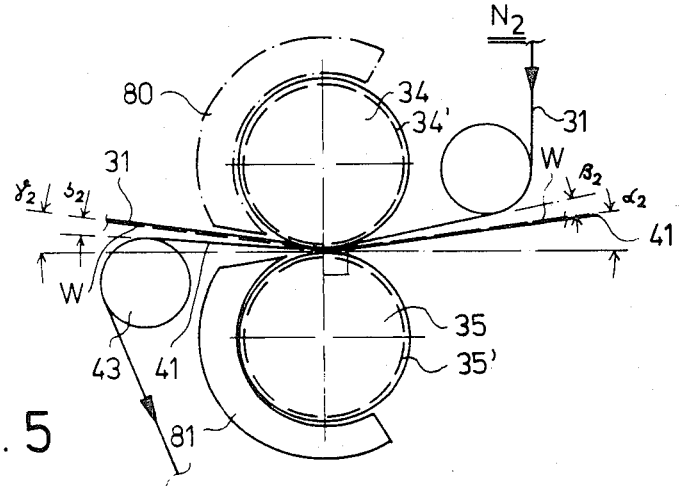
FIG. 5 is a schematic view showing the detailed geometry of the second nip of the press section shown in FIGS. 2 and 3.
Figure 6:
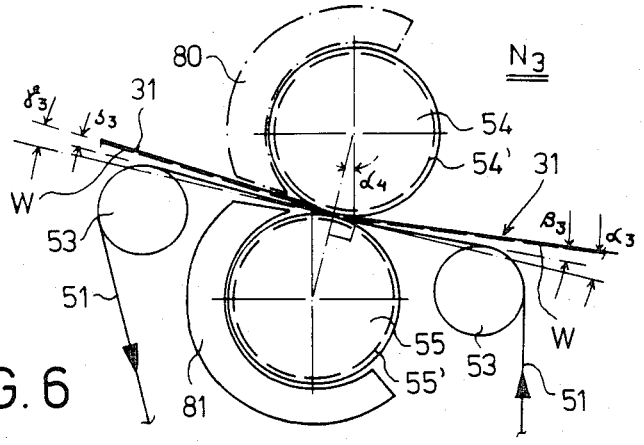
FIG. 6 is a schematic view showing a more detailed geometry of the third press nip of the press section illustrated in FIGS. 2 and 3.

As illustrated in FIGS. 4–6, water-collecting troughs 80 and 81 are provided after the press rolls in the direction of running of the web W. A water-collecting trough 80 is not necessarily required in connection with the upper rolls 34 and 54 of the second and third nips $N_2$ and $N_3$ if the transfer fabric 31 is completely impervious. Moreover, an open face 34' and 54' is not necessarily required for the latter press rolls 34 and 54, respectively, if the transfer fabric 31 is completely impervious. Open faces 34' and 54' are, however, preferable since such are useful in eliminating the blast of air which is induced by the various fabrics or by the web.

Referring to FIG. 4, the first nip $N_1$ is a horizontal nip and the first upper fabric 21 enters into the nip $N_1$ at an angle $\alpha_1$ relative to the horizontal plane (nip plane). The angle between the lower fabric 41 and the upper fabric 21 is denoted by $\beta_1$. The web W leaves the first press nip $N_1$ supported by the fabric 41 at an angle $\gamma_1$ relative to the horizontal plane. At the trailing side of the nip $N_1$, the angle between the first upper fabric 21 and first lower fabric 41 is denoted by $\delta_1$. Suitable ranges of these various angles, the most advantageous value of each angle generally being a value selected from a central region of the indicated range, are as follows:

$\alpha_1 = 0\text{–}10°$
$\beta_1 = 1\text{–}5°$
$\gamma_1 = 5\text{–}10°$
$\delta_1 = 1\text{–}5°$ As seen in FIG. 4, in view of the various angles as set forth above, the upper fabric 21 covers the web W after the central or vertical plane of the nip $N_1$ on the lower roll 25 within a central angle $\gamma_1 - \delta_1$. In this manner a so-called felt cover is obtained by means of which it is ensured that the web W will follow along with the lower fabric 41 after the first press nip $N_1$. This transfer of the web W from the first upper to the first lower fabric may be additionally ensured by provision of a suction device 72 which draws air through the lower fabric 41 and, at the same time, draws the web W into contact with the lower fabric 41. Moreover, the suction device 72 can function to absorb water from the bottom face of the fabric 41 and thereby reduce the moisture content in the lower fabric 41. Still further, the transfer of the web W from the first upper fabric 21 onto the first lower fabric 41 can also be ensured by means of an appropriate choice of the surface properties of the respective fabrics. In general, the first lower fabric 41 is chosen to have a smoother face then that of the first upper fabric 21.

Referring now to FIG. 5 which illustrates the second press nip $N_2$ of the press section of FIG. 2, the web W is shifted from the first water-receiving lower press fabric 41 to the second impervious non-water-receiving upper transfer fabric 31. The particular angles shown in FIG. 5 are chosen to ensure appropriate web transfer and preferably have values in the ranges as follows:

$\alpha_2 = 5\text{–}10°$
$\beta_2 = 3\text{–}10°$
$\gamma_2 = 5\text{–}10°$
$\delta_2 = 1\text{–}5°$ Thus, after the second press nip $N_2$, the fabric 41 covers the web W over an angle $\gamma_2 - \delta_2$ to obtain a so-called felt cover by means of which, as noted above, it is ensured that the web W will follow the transfer fabric 31 after the second press nip $N_2$. This can further be assured by providing that the face of the transfer fabric 31 is smoother than the face of the fabric 41. This usually can be achieved without much difficulty since the transfer fabric 31 is by its nature more impervious and therefore smoother than the water-receiving press fabric 41.

Referring now to FIG. 6 which illustrates the third press nip $N_3$ of the press section of FIG. 2, the third nip $N_3$ is an inclined nip defining an angle $\alpha_4$ relative to the vertical plane. Appropriate ranges for the respective angles as shown in FIG. 6 are as follows:

$\alpha_3 = 3\text{–}10°$
$\beta_3 = 3\text{–}10°$
$\gamma_3 = 0\text{–}5°$
$\delta_3 = 1\text{–}5°$ The values of the various angles noted above ensures that the web W will follow along with the transfer fabric 31 after the third press nip $N_3$. As noted above, the transfer fabric 31, as a rule, is provided with a face which is smoother than the face of the water-receiving press fabric 51 situated beneath it.

In accordance with the invention, a fully closed draw is provided for the web between the pick-up points $P_1$ and $P_2$ so that the web W is at all times supported by the face of a press fabric 20, 30, 40; 21, 41, 51 or of a transfer fabric 31; 50 with no unsupported open passages of the web W. This significantly improves the operating efficiency and reliability of the press section by reducing the frequency of web breakage during operation.

Referring to the press section illustrated in FIG. 1, dewatering of the web takes place in the first press nip $N_1$ in both directions, i.e., through both faces of the web as designated by the arrows V. This contributes to the symmetry of the web W. In the second and third nips $N_2$ and $N_3$, the dewatering takes place mainly upwardly as designated by the arrows V since the transfer fabric 50 is substantially non-water-receiving.

In the press section of FIGS. 2 and 3, the dewatering in the first press nip $N_1$ takes place in both directions as designated by the arrows V in FIG. 2, i.e., both towards the upper fabric 20 and towards the lower fabric 41. In the following press nips $N_2$ and $N_3$, the dewatering takes place downwardly as shown by arrows V in FIG.

2, i.e., towards the pervious, water-receiving press fabrics 41 and 51, but not upwardly to any major extent due to the imperviousness of the non-water-receiving transfer fabric 31. This selection of the dewatering direction has the advantage in practice that a web W treated in the press section has a relatively symmetric distribution of fines and filler agents for the reason that due to the mainly downward dewatering direction in the nips $N_2$ and $N_3$, fines and/or filler agents are carried towards the bottom face of the web W from where they had been previously washed away to a more than average extent due to the fact that the bottom face of the web W is in contact with the forming wire 10.

One of the essential features of the present invention is the use of the transfer fabric 50 and 31 described above which receives minimal amounts of water, if any, these fabrics additionally transferring the web W as a closed draw to the drying section. In the embodiment of FIG. 1, the transfer fabric 50 is the second lower fabric and passes through the nips $N_2$ and $N_3$ carrying the web W to the point $P_2$ where the web is transferred as a closed draw onto the drying wire 60. In the embodiment of FIGS. 2 and 3, the transfer fabric 31 is the upper fabric and passes through the nips $N_2$ and $N_3$ transferring the web to the point $P_2$ where the web W is transferred as a closed draw onto the drying wire 61. It is a characteristic of the transfer fabric 31;50 that it is substantially non-water-receiving which usually, but not necessarily, means that the transfer fabric 31;50 is relatively impervious. The transfer fabric 31;50 is, for example, a fabric produced by impregnating a conventional press felt with an appropriate plastic material. In some applications, the transfer fabric 31;50 may be to some extent pervious and/or water-receiving. As used herein and in accordance with the present invention, the term transfer fabric is used to denote such a fabric or band whose permeability (to air) is, as a rule, within the range of 0 to $2.0 m^3/m^2$ x min, when the difference in pressure $\Delta P = 10mm\ H_2O$ (water column). For the sake of comparison, it should be stated that the permeability to air of a normal new press felt is usually within the range of 10 to $30 m^3/m^2$ x min. The permeability to air of a normal used press felt is about $5\ m^3/m^2 \times$ min at $\Delta P = 10$ mm $H_2O$. It is also preferable that in addition to the transfer fabric 31;50 being substantially non-water-receiving, that it also be relatively dense and impervious so that its permeability is considered lower than the permeability of normal water-receiving press felts.

The surface properties of the transfer fabric 31;50 also influence the surface properties of the web W being treated in the press section as well as influencing which particular fabric the web follows after each nip. The transfer fabric 31;50 may be to some extent water-receiving, especially where thicker paper qualities are being produced. As a general rule, the thinner the paper qualities that are being prepared, the denser the transfer fabric 31;50 must be.

It is possible to use the transfer fabric or band that carries the web to the drying section in lieu of the drying wire 60; 61 shown in FIGS. 1 and 2 to be carried there, for example, by its roll face or fabric so that the web W will continue its passage in the drying section. In some cases it is also possible to use open draws in the drying section since the web W will obtain a relatively high dry matter content in the press section of the invention so that the web W will be relatively strong.

An illustrative non-limiting example of an experimental set up in accordance with the present invention is now set forth. The arrangement of the press section was substantially as shown in FIG. 2. The running speed of the web was 15m/s. The line pressures in the various nips were $P_{N1} = 70kN/m$, $P_{N2} = 100kN/m$ and $P_{N3} = 130kN/m$.

The dry matter content of the web after passing through the press section was about 44.5%. This is compared to the dry matter content obtained with a Sym-Press II under corresponding running conditions of about 41% so that, as compared to this case, the invention represents a considerable improvement.

The mass of the paper per unit area was about $45g/M^2$. The pulp used was cold newsprint pulp. The transfer felt 31 was an almost impervious fabric.

Moreover, it was found that the dry matter content of the web was substantially independent of the running speed of the press whereas in the case of the Sym-Press II press section, the dry matter content of the web is substantially reduced when the running speed of the press is increased.

Generally speaking, the line pressures in the various nips may be within the following ranges:

$P_{N1} = 50–100$ kN/m
$P_{N2} = 70–150$ kN/m
$P_{N3} = 90–250$ kN/m

In practice, it has been found that an appropriate combination of line pressures in the nip $N_1$, $N_2$ and $N_3$ is $P_{N1} = 70$ kN/m, $P_{N2} = 100$ kN/m and $P_{N3} = 130$ kN/m. In the present invention, it is possible to use higher line pressures than in conventional press sections such, for example, as the Sym-Press press section, since all of the nips are provided with two fabrics thereby making the nip areas relatively wide and since it is possible to use as press rolls solid-mantle (open-faced and in certain positions even smooth) cast-iron rolls which are substantially durable and less expensive than suction rolls with perforated mantles and smooth-faced stone rolls.

As noted above, even though the transfer fabrics 31; 50 have been described above as being substantially non-water-receiving, it will be understood that in certain cases it is possible to use as transfer fabrics fabrics which receive water at least to some extent. In such a case, however, as a rule, the water-receiving capacity and permeability of the transfer fabric concerned is substantially lower than that of ordinary press felt. On the other hand, in certain instances, it is possible to use a completely impervious band, e.g., a plastic or rubber band, as the transfer fabric.

In the press nips $N_1$, $N_2$ and $N_3$ it is possible to use arrangements known in themselves for supporting and loading the rolls. As a rule, one of the rolls of the press nips $N_1$, $N_2$ and $N_3$ is arranged as a roll having an adjustable or variable crown. Moreover, the press section in accordance with the invention includes various arrangements by which any web that becomes broken can be transferred onto the broke transportation equipment (not shown).

The closed draw from the press section to the drying section as shown in FIGS. 1–3, is also advantageous in the respect that, even if a drying wire 60 provided with a seam or any other corresponding transfer fabric is used, such seam will not leave its mark in the web since the transfer suction roll 62 operates against the resilient straight run of the transfer fabric 31; 50 and not against a hard roll face.

Obviously, numerous modifications and variations of the present invention are possible in the light of the above teachings. It is therefore to be understood that within the scope of the claims appended hereto, the invention may be practiced otherwise than as specifically described herein.

What is claimed is:

1. In a press section of a paper machine including, in the direction of the passage of the web through the press section, at least first, second and third successive press nips for removing water from the web to a substantial extent, each of said three press nips being a separate press nip, each press nip formed by its own separate pair of press rolls, and wherein each of said three press nips has a pair of fabrics passing therethrough so that the web is situated between two fabrics as it passes through each of said three press nips, and wherein dewatering takes place through both faces of the web in at least said first one of said three nips in the direction of web passage, said first press nip being formed between two open-faced rolls, and wherein said second and third press nips are formed between an open-faced roll and one of an open-faced roll and a smooth-faced roll, and wherein said press section includes a first upper fabric and a first lower fabric, one of said first upper and lower fabrics acting as a pick-up fabric onto which the web is transferred from a forming wire of the paper machine, the improvement comprising:

said press section includes two upper fabrics and two lower fabrics constituted by first upper and lower fabrics and second upper and lower fabrics in the direction of web run, and wherein said first upper and first lower fabrics are water-receiving press fabrics adapted to receive water removed from the web, and wherein one of said first upper and first lower fabrics constitutes a press fabric only in said first press nip and wherein the other of said first upper and first lower fabrics constitutes a press fabric both in said first press nip and in said second press nip;

wherein one of said second upper and second lower fabrics is a water-receiving press fabric adapted to receive water removed from the web, and wherein the other of said second upper and second lower fabrics is a substantially non-water-receiving transfer fabric; and wherein said transfer fabric constitutes means for transferring the web after said third nip as a closed draw to the drying section of the paper machine which follow the press section.

2. The combination of claim 1 wherein said first upper water-receiving press fabric passes over a pick-up means to pick-up the web from a forming wire and constitutes an upper press fabric both in said first press nip and in said second press nip;

said first lower fabric constitutes a press fabric only in said first press nip;

said second upper fabric is a water-receiving press fabric and constitutes a press fabric in said third press nip; and said second lower fabric is the non-water-receiving transfer fabric and passes through said second and third press nips and carries the web as a closed draw to the drying section of the paper machine which follows the press section.

3. The combination of claim 1 wherein said first upper water-receiving press fabric passes over pick-up means to pick-up the web from a forming wire and constitutes both a pick-up fabric and an upper press fabric only in said first press nip;

said first lower fabric constitutes both a lower press fabric in the first and second press nips and means for transferring the web on its upper face from said first press nip into said second press nip;

said second lower fabric is a water-receiving press fabric and constitutes a lower press fabric in said third press nip; and said second upper fabric is the non-water-receiving transfer fabric and constitutes both an upper fabric in the second and third press nips and as means for transferring the web as a closed draw to the drying section of the paper machine.

4. The combination of claim 1 wherein said non-water-receiving transfer fabric transfers the web onto a drying wire or the like of the paper machine drying section which follows the press section, and further including a transfer-suction roll having a suction zone over which the drying wire passes, said transfer fabric passing over said suction zone of said transfer-suction roll.

5. The combination of claim 1 wherein the web is dewatered in said first press nip in two directions, through both faces of the web, and wherein said transfer felt passes through said second and third press nips, the web being dewatered in the second and third press nips in substantially one direction only, through the face of the web which is not in contact with said transfer fabric as the web passes through said second and third nips.

6. The combination of claim 1 further including at least one steam supply box for applying steam to act against a free face of the web passing through the press section, whereby dewatering of the web in the press nips following said at least one steam box is intensified.

7. The combination of claim 1 wherein said first press nip is formed between two solid-mantle press rolls provided with open faces, at least one of said rolls being provided with a variable crown arrangement;

said second press nip is formed between a solid-mantle open-faced press roll and one of a solid-mantle open-faced press roll and a smooth-faced solid mantle roll situated in the loop of said transfer fabric, at least one of said rolls being provided with a variable crown arrangement; and said third press nip is formed between an open-faced solid mantle press roll and one of an open-faced solid mantle press roll and a smooth-faced solid mantle press roll, said smooth-faced press roll being situated within the loop of said transfer fabric.

8. The combination of claim 1 wherein the linear pressure in said first press nip is in the range of between about 50–100 kN/m.

9. The combination of claim 8 wherein said linear pressure in said first press nip is about 70 kN/m.

10. The combination of claim 1 wherein the linear pressure in said second press nip is in the range of between about 70–150 kN/m.

11. The combination of claim 10 wherein said linear pressure in said second press nip is about 100 kN/m.

12. The combination of claim 1 wherein the linear pressure in said third press nip is in the range of between about 90–250 kN/m.

13. The combination of claim 12 wherein said linear pressure is said third press nip is about 130 kN/m.

14. The combination of claim 1 wherein the permeability of said non-water-receiving transfer fabric is in the range of about 0 to 2.0 $m^3/m^2 \times$ min. when the pressure difference is about 10 mm $H_2O$.

* * * * *